United States Patent [19]

Neibaur

[11] Patent Number: 4,850,486

[45] Date of Patent: Jul. 25, 1989

[54] TRASH AND LIKE BAG AND BAG CLOSURE STORAGE AND DISPENSING

[76] Inventor: Ira L. Neibaur, 309 2nd St., Rupert, Id. 83350

[21] Appl. No.: 259,030

[22] Filed: Oct. 17, 1988

[51] Int. Cl.[4] ..... B65D 85/66

[52] U.S. Cl. ..... 206/390; 206/395; 206/409; 206/804; 24/30.5 R; 221/45

[58] Field of Search ..... 206/389, 390, 395, 409, 206/554, 804; 220/1 T, 229; 24/30.5 R, 30.5 W, 30.5 P, 30.5 L, 30.5 T; 221/45

[56] References Cited

U.S. PATENT DOCUMENTS

| | | | |
|---|---|---|---|
| 3,225,918 | 12/1965 | Mines | 206/390 |
| 3,417,863 | 12/1968 | Paxton | 206/57 |
| 3,417,864 | 12/1968 | Paxton | 206/554 |
| 3,446,344 | 5/1969 | Paxton | 206/390 |
| 3,718,251 | 2/1973 | Barnett | 206/47 |
| 3,749,296 | 7/1973 | Harrison | 206/409 |
| 3,857,139 | 12/1974 | Turner | 24/30.5 T |
| 4,349,123 | 9/1982 | Yang | 206/390 |
| 4,506,801 | 3/1985 | Origuchi | 206/390 |
| 4,529,636 | 7/1985 | Olson | 24/30.5 R |
| 4,597,494 | 7/1986 | Benoit | 206/409 |
| 4,602,664 | 7/1986 | Hullen | 24/30.5 R |

*Primary Examiner*—David T. Fidei
*Attorney, Agent, or Firm*—Lynn G. Foster

[57] ABSTRACT

A container containing trash and like bags and bag ties carried by the container with which to seal the open end of the bags. The bags and ties are individually manually dispensed from the container.

1 Claim, 2 Drawing Sheets

TRASH AND LIKE BAG AND BAG CLOSURE STORAGE AND DISPENSING

FIELD OF INVENTION

The present invention relates generally to the packaging and dispensing of trash and like bags and more specifically to an improved storage container for bags that facilitates dispensing of both trash and like bags and bag ties.

PRIOR ART

Various types of containers are known in the art whereby plastic trash and like bags, or other similar rolled, stacked or folded goods, are conveniently stored and dispensed on an individual, as needed basis. Such containers are typically provided with twistable tie wire closures or binders with which to manually close the trash ingress end of the bag after the bag is filled with trash. Usually, each of the ties includes a continuous wire filament enclosed and trapped by an adhesive between the folds of a longitudinally narrow paper or plastic ribbon. The ties are generally held together in a side-by-side fashion and frangibly attached together for easy manual separation.

There are at least two known prior art methods for storing and dispensing the above-mentioned ties. The first is typified by U.S. Pat. No. 3,718,251. This method cmprises sealing the ties into a small plastic bag and including that bag in the container in which the bags are stored without attaching it thereto. A significant problem with this method is that, although the ties are placed in a separate bag, the bag is loose and thus easily lost or misplaced once the larger bag container is opened. Even when the tie-containing bag has not been lost, it is still time consuming and aggravating to be required to search within the bag container for a tie each time one desires to close a bag. In this sense, the tie-containing bag is of little or no use for dispensing purposes. This problem is exacerbated by the fact that the location where the bags are stored is not always near the location where the bags are used and the ties needed.

The second known prior art method for storing and dispensing bag closures is disclosed in U.S. Pat. No. 3,417,863, in which a tie is individually attached to each bag at the time of manufacture by a spot of adhesive placed between the bag and the tie. While this method is convenient in that the ties and the bags are constantly stored and used together, the methodology is expensive and accidental or inadvertent detachment of the ties from the bags during storage, handling or use is an ongoing problem.

BRIEF SUMMARY AND OBJECTS OF THE INVENTION

In brief summary, the present invention overcomes or substantially alleviates the cited prior art problems by providing an improved container for the storage and dispensing of rolled, stacked or folded plastic bags and bag closures. The present invention comprises a plurality of trash or like bags housed in a bag container from which the bags are dispensed manually as needed and bag ties associated with the container for individual manual dispensing as needed. In one presently preferred form of the present invention an aperture is placed through the container and the aperture equipped with resilient fingers with memory which hold ties placed therethough for individual removal.

With the foregoing in mind, it is a primary object of the present invention to provide a novel combination comprising a supply of trash or like bags and a supply of bag ties carried by the container for independent manual dispensing of the bags and the ties, respectively, and related methods.

It is a further paramount object to provide a storage and dispensing container from which ties and trash or like bags are individually available and dispensed as needed without having to locate ties separated from the container.

Another object of significance is the provision of a trash or like bag and bag tie storage and dispensing container, and related methods, having one or more of the following features and advantages: noncomplex, simplified construction, inexpensive, easy to use, convenient, utilizes few parts and time efficient.

These and other objects and features of the present invention will be apparent from the detailed description taken with reference to the accompanying drawings.

DETAILED DESCRIPTION OF THE ILLUSTRATED EMBODIMENT

Figure 1:
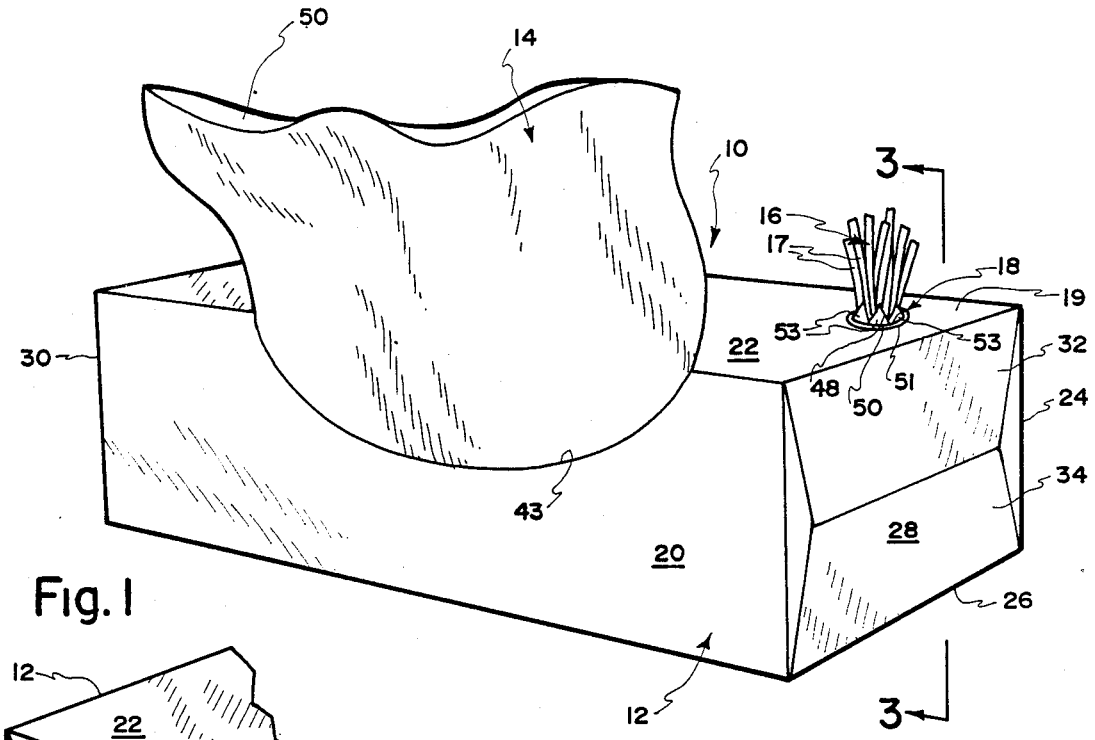
FIG. 1 is a front perspective showing a trash or like bag and bag tie storage and dispensing container, embodying the present invention, in a ready-to-use position.

Reference is now made in detail to the FIGS. 1–5, wherein like numerals are used throughout to designate like parts. FIGS. 1–5 illustrate a presently preferred trash or like bag and bag closure storage and dispensing container, generally designated 10. The present invention 10 comprises a standard bag-containing container or box, generally designated 12, a supply of severable or separate rolled, stacked or folded bags, generally designated 14 to be manually removed from the box 12 as needed, a supply of standard wire bag ties, generally designated 16, for selective removal from the container 12 by the user and bag tie dispensing structure, generally designated 18, each of which is hereinafter described in greater detail.

Figure 2:
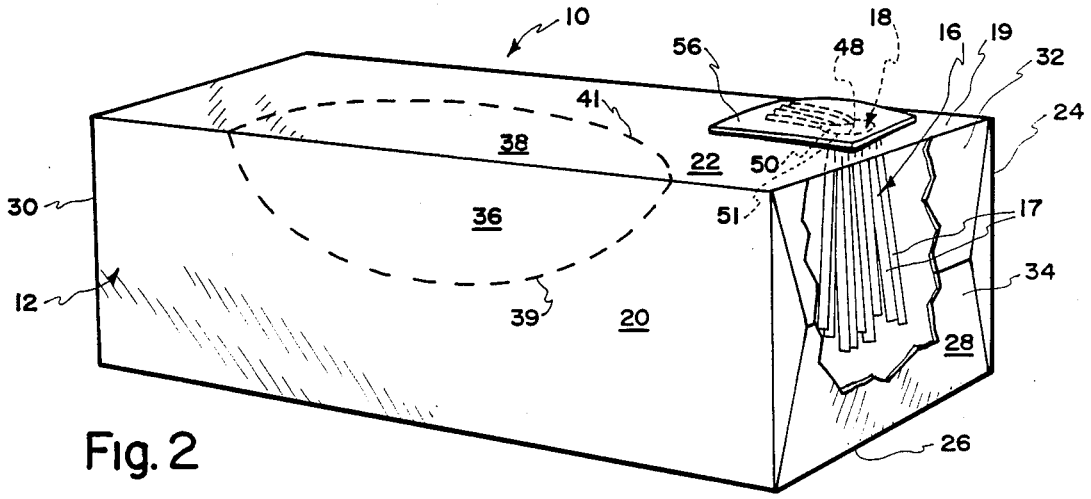
FIG. 2 is a front perspective of the container of FIG. 1 shown in the opened position.
Figure 3:
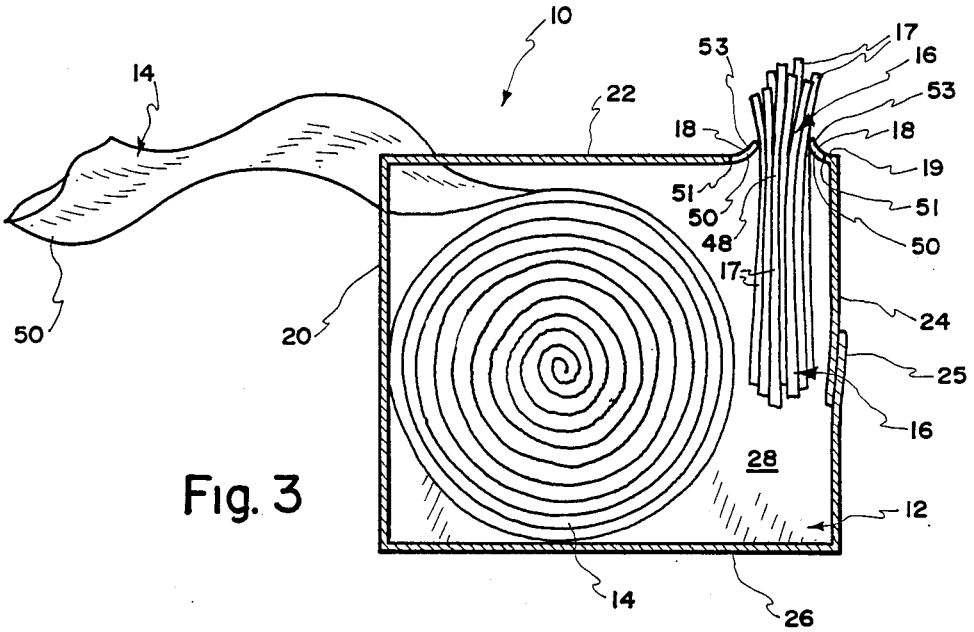
FIG. 3 is a side elevation of the container of FIG. 1 taken along lines 3—3 of FIG. 1 showing a typical roll of bags within the container and a set of individually dispensable bag ties carried by the container in their "as used" position.
Figure 4:
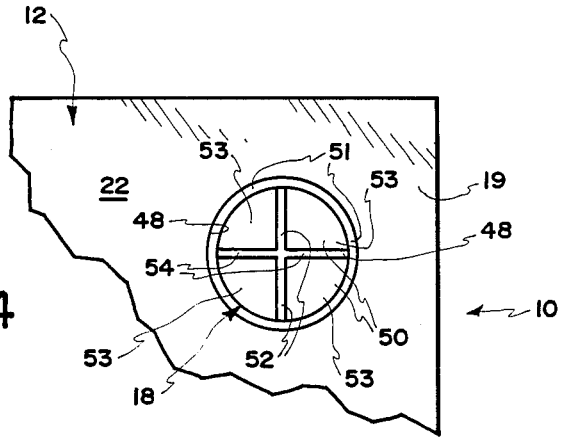
FIG.4 is an enlarged fragmentary plan view of the bag tie holding and dispensing structure with the ties removed for clarity.
Figure 5:
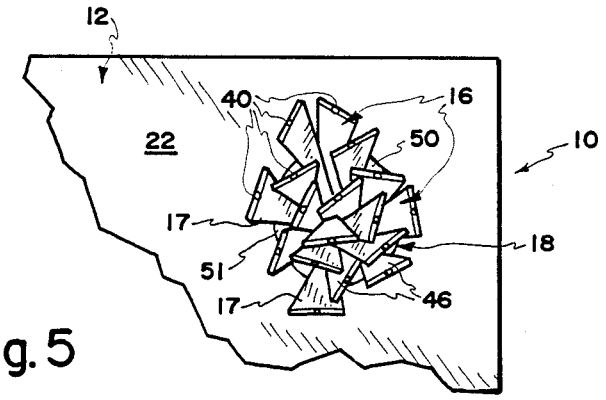
FIG. 5 is an enlarged fragmentary plan view similar to FIG. 4 but shown with bag ties being held by the tie holding and dispensing structure.

Box 12 is preferably formed of a single piece of die stamped, folded cardboard or the like. The box 12 is illustrated as being three dimensionally rectilinear and as comprising four generally rectangular flat sides 20, 22, 24, 26 and two substantially square flat ends 28 and 30. Both ends 28 and 30 comprise folded and adhesively secured flaps 32 and 34 one of which, when initially opened, receives the roll of trash or like bags 14, and the ties 16. Side 24 comprises a glued lap joint 25. See FIG. 3. The flaps 32 and 34 are closed and glued after inserting the desired contents, but prior to sale or use. Sides 20 and 22 contain arcuately-shaped frangible areas 36 and 38, scored at lines 39 and 41. Frangible areas 36 and 38 are positioned in correlation to each other so as to form one continuous football-shaped scored area, as shown in FIGS. 1 and 2. At the time of use, the scored areas 36 and 38 are manually severed from the remainder of the container 12 so as to provide an access opening to the bags contained within the box 12. Thus, for the most part, the box 12 is conventional.

The illustrated supply of bags 14 is conventional and made of a pliant plastic. However, it is realized that available bags of other suitable materials such as paper may be substituted without departing from the scope of this invention. The bags 14 may be rolled, stacked or folded, as is standard in the industry. The area within the scored lines 39 and 41 which, with section 36 and 38 removed, provides an access opening 43 (FIG. 1) to the supply of bags 14 such that the leading edge 50 of the first bag can be exposed and the bags individually dispensed seriatum as needed.

The supply of ties 16 are releasibly carried by the box 12 near one corner thereof. Each tie 17 may comprise a conventional continuous wire filament 40 which is trapped by an adhesive or the like between folds of a longitudinally folded narrow paper ribbon 46. See FIG. 5. As presently preferred, a set 16 of ties 17 is included in the box at purchase. The preferred ties 17 are not attached to each other and yet standard ties which are connected together which can be individually dispersed from the container may be used. The purpose of each tie 17 is to seal or close off the open end of a bag 14 in a manner well known in the art.

Tie dispensing structure 18, best shown in FIGS. 1–4, comprises a circular aperture 48 disposed in the box 12 near corner 19 of the side 22. A flat, round button 50 is press-fit or glued in the aperture at button perimeter 51. Button 50 is preferably formed of synthetic resinous material with memory. The button 50 comprises four fingers comprising quarter sections of the button. See FIG. 4. The quarter fingers 53 are separated one from another by perpendicularly disposed linear spaces 52 and 54. The fingers 53 are more yieldable at their central tips than at the perimeter ring 51. Thus, when a hand-held bundle 16 of ties 17 is forced at one end against the button 50, the fingers 53 yield beginning at the tips through substantially 90°. With the central part of the bundle 16 of ties 17 contiguous with the fingers 53, the memory of the material from which the fingers of mode exerts an inward force on the bundle 16 to hold the same in place statically, as illustrated in FIG. 1, while facilely accommodating individual manual removeal of each tie 17 as needed.

These are two presently preferred alternative methods in which the dispensing unit 18 may be prepared for use. With the first method, shown in FIG. 2, the ties 16 are inserted through the fingers 53 of the quartered plastic button 50 at the time of manufacture. The ends 55 of the ties 16 which protrude outside of the box 12 may be folded over such as to be flush with side 22 of box 12. The bundle of ties 16 is then secured to the box 12 by a piece of plastic tape 56 or the like as shown in FIG. 2. In preparation for use, the tape 56 manually removed and the ties 16 are straightened, to the position of FIG. 1, to facilitate dispensing.

The second method places the bundle of ties 16 within the box 12 at the time of manufacture. The user then manually inserts the bundle of ties 16 through the fingers 53 the plastic button 50 only after the box has been opened in anticipation of use.

Figure 6:
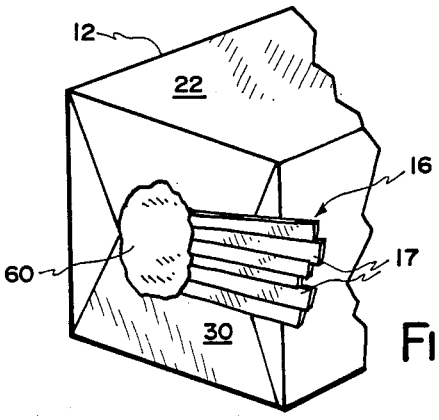
FIG. 6 is a fragmentary perspective of a second presently preferred bag tie dispensing container according to the present invention.

With reference to FIG. 6, the bundle 16 of ties 17 may be releasibly secured at one end thereof by a mass of paraffin wax 60 or the like. The free ends of the ties 17 may be bent into contiguous relation with the exterior of the box 12 at the time of manufacture.

The invention may be embodied in other specific forms without department from the spirit or essential characteristics thereof. The present embodiment, is, therefore, to be considered in all respects as illustrative and not restrictive, the scope of the invention being indicated by the appended claims rather than by the foregoing description, and all changes which come within the meaning and range of equivalence of the claims are therefore to be embraced therein.

What is claimed and desired to be secured by United States Letters Patent is:

1. A combination comprising:

a supply of trash or like bags;

a supply of bag ties;

a hollow container the supply of bags being disposed for sequential removal in the hollow of the container;

means which releasibly secure the supply of ties to the container so that at least part of each tie is accessible to a user for individual manual tie removal, the releasibly securing means comprising resilient finger means with memory disposed in an opening in the container.

* * * * *